US005446390A

United States Patent [19]

Marks

[11] Patent Number: 5,446,390

[45] Date of Patent: Aug. 29, 1995

[54] METHOD AND APPARATUS FOR MONITORING AND DISPLAYING SEQUENTIALLY OPERATING CONDITIONS OF A PLURALITY OF DEVICES

[75] Inventor: Ted M. Marks, Kendall Park, N.J.

[73] Assignee: SGS-Thomson Microelectronics, Inc., Carrollton, Tex.

[21] Appl. No.: 183,561

[22] Filed: Jan. 19, 1994

Related U.S. Application Data

[63] Continuation of Ser. No. 821,013, Jan. 15, 1992, abandoned.

[51] Int. Cl.[6] ..... G08B 19/00

[52] U.S. Cl. ..... 324/555; 340/521; 371/67.1

[58] Field of Search ..... 324/500, 520, 522, 555; 340/521, 531, 539, 659, 660, 661; 341/101; 371/2.1, 25.1, 67.1, 69.1

[56] References Cited

U.S. PATENT DOCUMENTS

| | | | |
|---|---|---|---|
| 3,581,014 | 8/1971 | Vogel | 340/524 X |
| 4,023,144 | 5/1977 | Koenig | 341/101 |
| 4,153,881 | 4/1978 | Permut et al. | 325/64 |
| 4,258,421 | 3/1981 | Juhasz et al. | 364/424.04 |
| 4,325,146 | 4/1982 | Lennington | 455/604 |
| 4,376,298 | 3/1983 | Sokol et al. | 364/551 |
| 4,581,606 | 4/1986 | Mallory | 340/539 |
| 4,677,429 | 6/1987 | Glotzbach | 340/521 |
| 4,924,418 | 5/1990 | Bachman et al. | 364/550 |
| 5,061,917 | 10/1991 | Higgs et al. | 340/539 |
| 5,081,626 | 1/1992 | Scott | 371/22.4 |

OTHER PUBLICATIONS

Secondary Radar Fundamentals and Instrumentation, P. Honold ISBNO-85501-248-X Heyden and Son Ltd., London, pp. 5-29, 1976 (month unavailable).

*Primary Examiner*—Kenneth A. Wieder
*Assistant Examiner*—Christopher M. Tobin
*Attorney, Agent, or Firm*—Allan Ratner; Rodney M. Anderson; Lisa K. Jorgenson

[57] ABSTRACT

Apparatus for displaying operating conditions of a device in which voltages that are produced when respective operating conditions exist are formed into a series of pulses with a bracket pulse on at least one end of the series and a display of indications of the presence of pulses at locations corresponding to their positions in the series.

7 Claims, 2 Drawing Sheets

METHOD AND APPARATUS FOR MONITORING AND DISPLAYING SEQUENTIALLY OPERATING CONDITIONS OF A PLURALITY OF DEVICES

The present application is a continuation of copending application Ser. No. 07/821,013, filed Jan. 15, 1992, now abandoned.

BACKGROUND OF THE INVENTION

In transmitters where the radio frequency output power is attained by combining the outputs of as many as thirty to forty modules, it is desirable to monitor certain operating characteristics of each module. This can be done on a routine basis or in the event of a suspected malfunction of the transmitter. Whereas this can be accomplished by removing each module and checking it in a bench set-up, this requires an inordinate amount of time. Furthermore, there are circumstances where the malfunction can only be detected with the module in its operating position.

BRIEF SUMMARY OF THE INVENTION

In accordance with this invention, each module is provided with means for detecting certain operating conditions. When a condition is present, a high state voltage is produced, and, in a preferred embodiment of the invention, these voltages are loaded in parallel into the registers of a shift register in response to a triggering pulse. For a given period thereafter, clock pulses are applied to the shift register so as to produce a sequential pulsed data stream at its output. Bracket pulses are formed at one or both ends of the sequence in such manner that the respective times between a bracket pulse and the pulses representing operating conditions are always the same. Thus, once a microprocessor identifies a bracket pulse, the condition represented by any pulse in the sequence can be identified by simply noting the time between them.

Whereas only one bracket pulse is required, it is preferable that two be used. The one at the leading end of the sequence indicates that monitoring is under way, and the one at the trailing end of the sequence indicates that the monitoring is completed.

Once a sequence of pulses is derived, indications of the presence and absence of the pulses representing operating characteristics are displayed at locations corresponding to their positions in the sequence so that the presence or absence of a condition can readily be determined. In order to facilitate reading of the display, it is preferable that there be spaces between the pulses.

It is, of course, necessary that the module from which a sequence of pulses is derived be identified. This is easily done by programming a microprocessor so as to supply trigger pulses to the means for detecting operating conditions in each module and selecting the sequence of signals to be displayed from the module of interest. Alternatively, the microprocessor can be programmed to supply a trigger pulse to the detecting means in the module of interest, and coupling the outputs of all the detecting means to the display means.

Means other than a shift register can be used to convert the pulses representing operating conditions into a sequential pulsed data stream e.g., a switch could be successively connected to the outputs of the operating condition detecting means as well as to means supplying a D.C. voltage from which bracket pulses are derived.

Whereas the invention is described in connection with amplifying modules, it could be applied to a system using different kinds of devices.

DETAILED DESCRIPTION OF THE DRAWINGS

Before making detailed references to the drawings, the sequential data stream produced by each amplifying module, in an exemplary application of the present invention, is set forth in the table below wherein the left column indicates the times from the beginning of a bracket pulse at which pulses for the conditions in the right column occur.

| Time From Bracket Pulse | FAULT |
|---|---|
| 2 us | Low output Power (< −2 dB) |
| 4 us | DC Present (+45 v, +15 v, −15 v, +5 v) |
| 6 us | Over Temperature |
| 8 us | Excessive Pulse Width |
| 10 us | Excessive Duty Factor |
| 12 us | Load VSWR > 2:1 |
| 14 us | Input Power Too Low |
| 16 us | Input Power Too High |
| 18 us | Undefined |
| 20 us | End Bracket, Pulse Always Present |

Figure 1A:
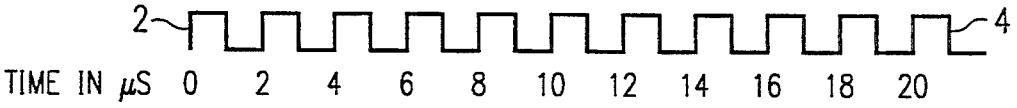
FIG. 1A illustrates all sequential pulses that may be displayed so as to readily indicate the operating conditions that are present.
Figure 1B:
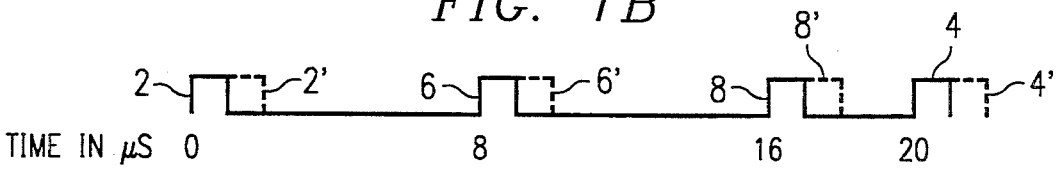
FIG. 1B illustrates the display when only a few operating conditions are present.

Since, in a preferred embodiment, the time between pulses is 2 us and their width is only 1 us, there is a 1 us space between all pulses as illustrated in FIG. 1. In this figure all pulses of the table are shown and the times from the first bracket pulse are indicated. The bracket pulses need not be displayed as long as zero time coincides with the beginning of the first bracket pulse. Usually, however, all operating conditions are not present, as illustrated in FIG. 1B, wherein only pulses indicated by the numerals 6 and 8 representing "excessive pulse width" and "input power too high" that respectively appear at 8 us and 16 us after the bracket pulse 2 are shown. Since only the presence of a pulse need be displayed, this can be done with LED's.

Figure 2:
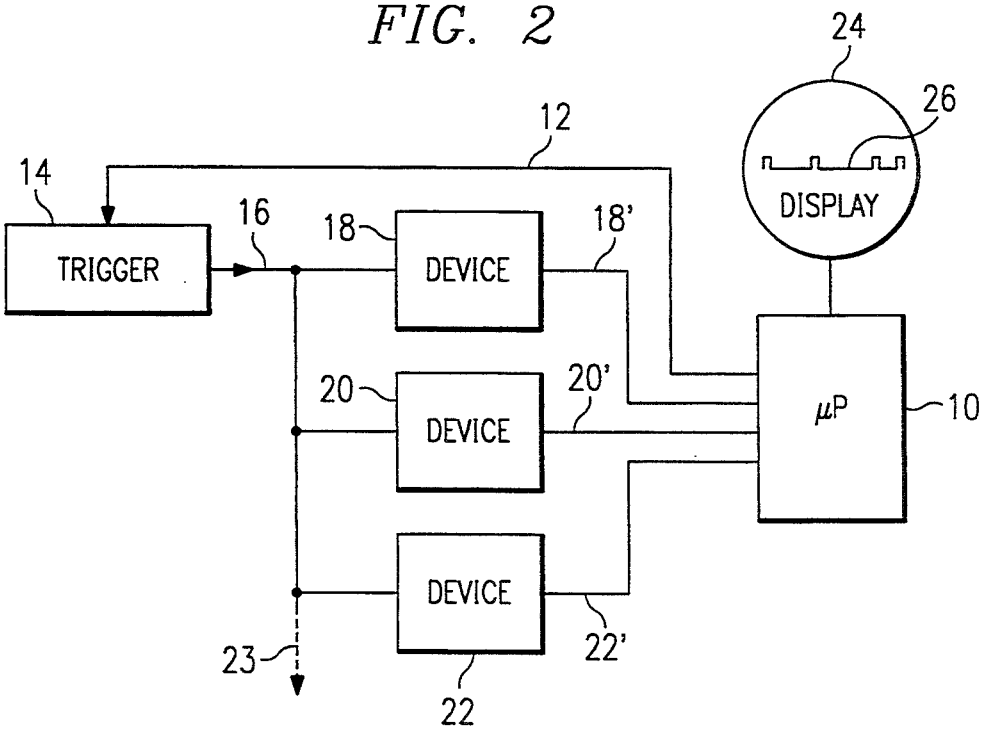
FIG. 2 is a block diagram of a system for determining the operating condition of any one of a number of modules or devices in accordance with this invention wherein triggering pulses are applied to all the modules or devices.

FIG. 2 is a block diagram of a system constructed in accordance with the invention for displaying indications of the existence of operating conditions of a selected one of a plurality of devices such as amplifier modules. When operating conditions are to be ascertained, a microprocessor 10 sends a signal via a lead 12 to activate a means 14, which may be an amplifier, for producing or generating a trigger pulse. The trigger pulse is supplied via a lead 16 to means, not shown, in each of a plurality of devices 18, 20 and 22 for producing a sequential pulse data stream such as shown in FIG. 1B. As indicated by the dashed line 23, the system can have more than three devices. The manner in which such a pulse data stream is produced in each device will be explained in connection with FIG. 4. The microprocessor 10 is respectively coupled via leads 18', 20' and 22' to the devices 18, 20 and 22 so as to receive the pulse data streams produced in each device. Means, not shown, are provided in the microprocessor 10 for selecting the pulse data stream from the device of interest, and supplying it to a display means 24. The display means 24 produces indications such as at 26 as to the presence or absence of pulses corresponding to given operating conditions such as shown in FIG. 1A. Although not shown, the condition for each pulse position, such as those shown in the table, is printed in alignment with that position.

Figure 3:
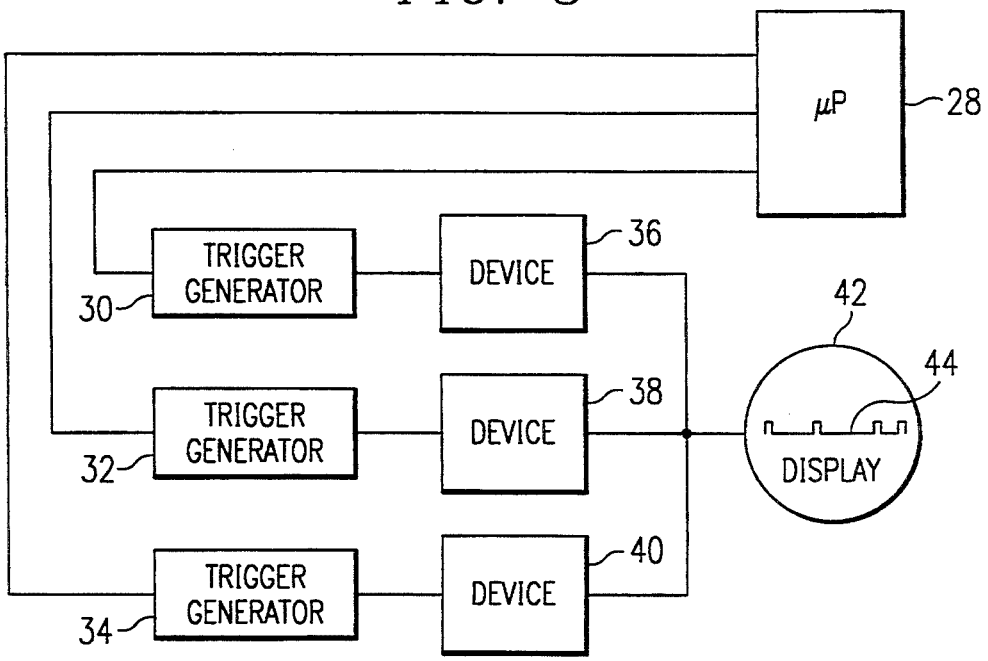
FIG. 3 is a block diagram of a system for determining the operating condition of any one of a number of modules or devices in accordance with this invention wherein triggering pulses are applied to the module or device of interest.

The system of FIG. 3 differs from that of FIG. 2 only in the manner of selecting the device for which the operating condition is sought. Here, a microprocessor 28 activates only one of trigger pulse generators 30, 32, and 34 that are respectively coupled to means in devices 36, 38, and 40 for providing sequences of pulses representing respective operating conditions. All of these means are coupled to a display means 42 which indicates the presence of respective pulses as shown at 44. Although only three devices are shown, any number can be used.

Figure 4:
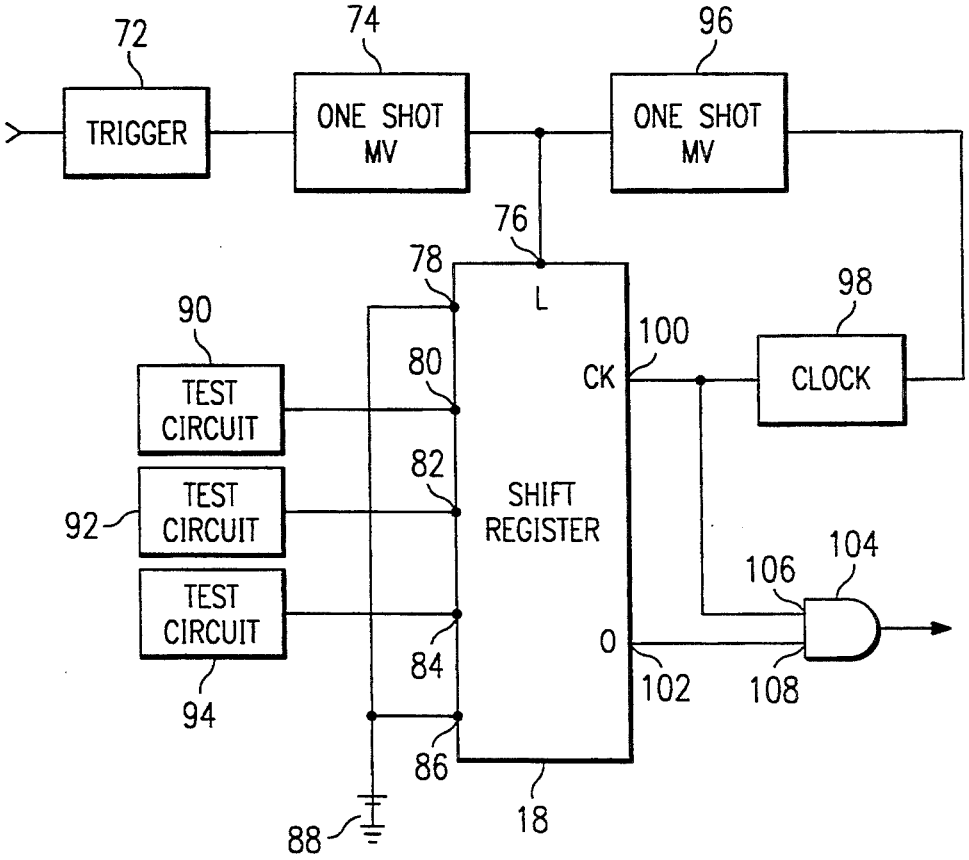
FIG. 4 is a block diagram of means for use in each module or device for producing a sequential data stream in accordance with a preferred embodiment of this invention.

Reference is now made to FIG. 4 for a description of the monitoring circuitry in each of the devices or modules 18, 20 and 22 of FIG. 2 and 36, 38, and 40 of FIG. 3. A trigger signal from a microprocessor such as 10 of FIG. 2 and 28 of FIG. 3 is applied to a trigger circuit 72 that generates a pulse for driving a one shot multivibrator 74. The output pulse of the multivibrator 74 is applied to a load terminal 76 of a shift register 78, which may be a shift register identified by the code number V22 54LF676 having stages, not shown, that can be loaded in parallel and discharged in series.

During a pulse from the multivibrator 74 that is applied to the load terminal 76, high state voltages that are produced at load terminals 78, 80, 82, 84 and 86 in a manner to be described are respectively coupled to stages in the shift register 76. A high state voltage provided by a source such as a battery 88 is applied to the end load terminals 78 and 86, and a plurality of test circuits 90, 92 and 94 are respectively connected to the load terminals 80, 82 and 84. Only three test circuits are shown to simplify the drawing, but any number can be used. If, for example, the operating conditions of the table infra are to be indicated, nine test circuits would be used. Each test circuit provides a high state voltage when a particular operating condition exists. Thus, for example, if the circuit 90 is for low output power, it provides a high state voltage when the output power is low etc.

Figure 1C:
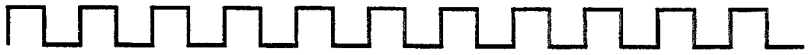
FIG. 1C illustrates the clock pulses used for the shift register.

The pulse provided by the one shot multivibrator 74 is also applied to another one shot multivibrator 96. The multivibrator 96 is triggered by the trailing edge of the pulse from the multivibrator 74 so that all of the stages of the shift register 78 have been loaded and disconnected from the load terminals 78, 80, 82, 84 and 86 when the pulse from the multivibrator 96 commences. This pulse is applied so as to enable a clock 98 having its output pulses applied to a clock terminal 100 of the shift register 78. The clock pulses are indicated in FIG. 1C and are seen to correspond to the pulses of FIG. 1A representing the desired timing of the pulses representing the various operating conditions.

In view of the fact that the voltage shifts from one stage of the shift register 78 to the next in response to the rising edge of a clock pulse, the pulses at an output terminal 102 of the shift register 78 would be extended to two microseconds in width as indicated by the dashed lined 2', 6', 8' and 4' of FIG. 1B. This means that there would be no space between pulses at the output terminal 100 if two successive operating conditions occurred, e.g., if the outputs of the test circuits 90 and 92 had high state outputs. Although one could still see whether an operating condition is present by noting whether there is a high voltage indication for it, it is much easier to determine the operating conditions present if indications for them are separated. For this reason an AND gate 104 is provided having one input 106 connected to the output of the clock 98 and another input 108 connected to the output terminal 102 of the shift register 78. High state output pulses only appear at the output of the AND gate 104 during a positive half cycle of a clock pulse so that the portions of the output pulses of the shift register 78 such as represented by the dashed lines 2', 6', 8' and 4' have no effect. Thus there are spaces between any pulses in the sequence at the output of the AND gate 104 that are applied to display means such as 24 and 28 of FIGS. 2 and 3 respectively.

The shift register 78 is in effect a means that can be loaded in parallel with voltages corresponding to brackets and the existence of various operating conditions and unloaded in series so that the voltages form a burst or series of pulses.

What is claimed is:

1. Apparatus for indicating, on demand, monitored operating conditions of a plurality of devices comprising:

a control circuit for generating a request signal to request an indication of the operating conditions of a selected one of the plurality of devices;

a plurality of trigger circuits, each associated with one of said plurality of devices, each trigger circuit outputting a trigger signal responsive to receiving a request signal indicating selection of its associated device;

test circuitry, coupled to each device, for providing operating condition signals indicative of the operating conditions of the respective device;

a plurality of operating signal circuits, each associated with one of said plurality of devices, each operating signal circuit coupled to its associated trigger circuit to store a sequence of the operating condition signals corresponding to its associated device and to output the stored sequence of operating condition signals to said control circuit responsive to receiving the trigger signal from its associated trigger circuit; and a display, controlled by said control circuit, for visually displaying the outputted operating condition signals.

2. Apparatus for indicating, on demand, monitored operating conditions of a plurality of devices, comprising:

a control circuit for generating a request signal to request an indication of the operating conditions of a selected one of the plurality of devices;

a single trigger circuit, coupled to said control circuit and to each of the plurality of devices, for outputting a trigger signal to the selected one of the plurality of devices responsive to receiving the request signal;

test circuitry, coupled to each of said plurality of devices, for providing operating condition signals indicative of the operating conditions of the respective device;

a plurality of operating signal circuits, each associated with one of said plurality of devices, each operating signal circuit coupled to said trigger circuit to store the operating condition signals corresponding to its associated device in sequence, and to output the stored sequence of operating condition signals to the control circuit, both responsive to the trigger signal; and a display, controlled by said control circuit, for visually displaying the outputted operating condition signals.

3. An apparatus for displaying, on demand, monitored operating conditions of a device, said apparatus comprising:

a processor for generating a request signal to request an update of the operating conditions of the device;

trigger means for receiving the request signal and outputting a trigger signal responsive thereto;

test means, coupled to the device, for providing operating condition signals indicative of the operating conditions;

operating signal means for storing the operating condition signals in a sequence responsive to the trigger signal, and for presenting the stored sequence of operating condition signals to said processor;

a clock circuit, coupled to said operating signal means, for serially clocking out the stored sequence of operating condition signals;

gating circuitry, coupled to an output of the operating signal means and to the clock circuit, and having an output coupled to the processor, for inserting a known logic level between adjacent ones of said operating condition signals prior to presentation of the stored sequence to the processor; and display means, coupled to said processor, for visually displaying the presented operating condition signals.

4. A method of for indicating, on demand, monitored operating conditions of a device, comprising the steps of:

requesting an update of the operating conditions of the device;

transforming the request into a trigger signal;

storing, in response to the request of the requesting step, a sequence of monitored operating condition signals indicative of the operating conditions, by loading the sequence of monitored operating conditions signals into a shift register;

outputting, in response to the trigger signal, the stored sequence of operating condition signals in combination with a framing signal at the beginning and the end of the sequence by presenting a clock signal to the shift register to clock the stored sequence of operating condition signals from an output of the shift register and by gating the signals at the output of the shift register with the clock signal to insert a known logic level between adjacent ones of the operating condition signals; and displaying the outputted sequence of operating condition signals.

5. The apparatus as set forth in claim 3 wherein the operating signal means further comprises:

shift register means including:

a plurality of stages, each stage for holding a signal, a loading terminal for each stage, each loading terminal for receiving one of 1) one of the operating condition signals and 2) a framing signal indicative of a beginning or an end of a datastream, means, responsive to the trigger signal, for causing the signals being received by said loading terminals to be loaded into and held by their respective stages; and means, responsive to the trigger signal, for clocking said shift register such that every one of the signals held by the shift register are output in series.

6. The apparatus as set forth in claim 5 wherein the plurality of stages includes a first and last stage, and wherein the first stage is for holding a framing signal and the remaining stages are for holding signals indicative of operating conditions.

7. The apparatus as set forth in claim 5 wherein the plurality of stages includes a first and last stage, and wherein the first and last stages are for holding framing signals and the remaining stages are for holding signals indicative of operating conditions.

* * * * *